US007347156B2

(12) United States Patent
Lindblade

(10) Patent No.: US 7,347,156 B2
(45) Date of Patent: Mar. 25, 2008

(54) LOWER BEARING ASSEMBLY FOR DISCONNECTABLE TURRET

(75) Inventor: Stephen P. Lindblade, Waller, TX (US)

(73) Assignee: Sofec, Inc., Houston, TX (US)

( * ) Notice: Subject to any disclaimer, the term of this patent is extended or adjusted under 35 U.S.C. 154(b) by 139 days.

(21) Appl. No.: 10/831,580

(22) Filed: Apr. 23, 2004

(65) Prior Publication Data

US 2004/0261682 A1 Dec. 30, 2004

Related U.S. Application Data

(60) Provisional application No. 60/465,093, filed on Apr. 23, 2003.

(51) Int. Cl.
*B63B 22/02* (2006.01)
*B63B 21/50* (2006.01)

(52) U.S. Cl. ..... 114/230.12; 441/4

(58) Field of Classification Search ..... 441/3–5; 114/230.1, 230.12, 293; 166/355
See application file for complete search history.

(56) References Cited

U.S. PATENT DOCUMENTS 5,065,689 A * 11/1991 Krogstad ..... 114/230.12
5,339,760 A * 8/1994 Korsgaard ..... 441/3
5,380,229 A * 1/1995 Korsgaard ..... 441/3
5,651,708 A * 7/1997 B.o slashed.rseth ..... 441/5
5,782,197 A * 7/1998 Pollack ..... 114/230.12
5,823,131 A * 10/1998 Boatman et al. ..... 114/230.12
6,477,974 B2 * 11/2002 Hobdy ..... 114/230.12
2004/0029464 A1 * 2/2004 Pollack et al. ..... 441/4

FOREIGN PATENT DOCUMENTS

FR 2670742 A1 * 6/1992
FR 2770484 A1 * 5/1999
GB 2299315 A * 10/1996
WO WO 9324733 A1 * 12/1993
WO WO 9404412 A1 * 3/1994
WO WO 9952764 A1 * 10/1999

* cited by examiner

*Primary Examiner*—Ajay Vasudeva
(74) *Attorney, Agent, or Firm*—Henry C. Query, Jr.

(57) ABSTRACT

A turret mooring system for a vessel comprises a turret which is rotatably connected to the vessel and comprises a lower end, a buoy which is anchored to the sea floor and is releasably connectable to the lower end, and a bearing assembly which is positioned between the buoy and the vessel when the buoy is connected to the turret. In this manner, horizontal mooring loads acting on the buoy are transmitted through the bearing assembly to the vessel.

16 Claims, 3 Drawing Sheets

LOWER BEARING ASSEMBLY FOR DISCONNECTABLE TURRET

This application is based on U.S. Provisional Patent Application No. 60/465,093, which was filed on Apr. 23, 2003.

BACKGROUND OF THE INVENTION

The present invention is directed to a lower bearing assembly for a turret mooring system which comprises a disconnectable buoy. More particularly, the invention is directed to a bearing assembly which transmits the horizontal mooring loads directly from the buoy to the vessel.

Turret mooring systems are commonly used to anchor a vessel to the sea floor. Disconnectable turret mooring systems typically comprise a buoy which is anchored to the sea floor and which is connectable to a turret that is rotatably supported by the vessel. During operation, the buoy may be hoisted from a submerged position below the vessel and connected to the bottom of the turret to thereby moor the vessel to the sea floor.

The turret is usually supported in the vessel by both upper and lower bearing assemblies. The upper bearing assembly typically comprises a combination axial and radial bearing which is capable of transmitting both the vertical and horizontal mooring loads from the turret to the vessel. The lower bearing assembly usually comprises a radial bearing which transmits only the horizontal mooring loads from the turret to the vessel.

Thus, in conventional turret mooring systems both the upper and lower bearing assemblies are positioned between the turret and the vessel. Consequently, the turret must typically be sufficiently long to extend from the upper bearing assembly to the lower bearing assembly. However, the greater the length of the turret, the more difficult and expensive the turret is to manufacture.

SUMMARY OF THE INVENTION

In accordance with the present invention, these and other disadvantages in the prior art are overcome by providing a bearing assembly for a turret mooring system which includes a turret that is positioned in a moon pool of a vessel and is anchored to the sea floor through a disconnectable buoy. The bearing assembly comprises a bearing support ring which is connected to the vessel, a reaction ring which is positioned concentrically within the bearing support ring and is adapted to engage the buoy, and a bearing ring which is positioned between the bearing support ring and the reaction ring.

Since the bearing assembly is positioned between the vessel and the buoy, the horizontal mooring loads acting on the buoy will be transmitted directly to the vessel instead of through the turret. As a result, the turret may be made shorter and lighter than prior art turrets which are designed to accommodate similar mooring loads.

These and other objects and advantages of the present invention will be made apparent from the following detailed description, with reference to the accompanying drawings.

DETAILED DESCRIPTION OF THE PREFERRED EMBODIMENTS

Figure 1:
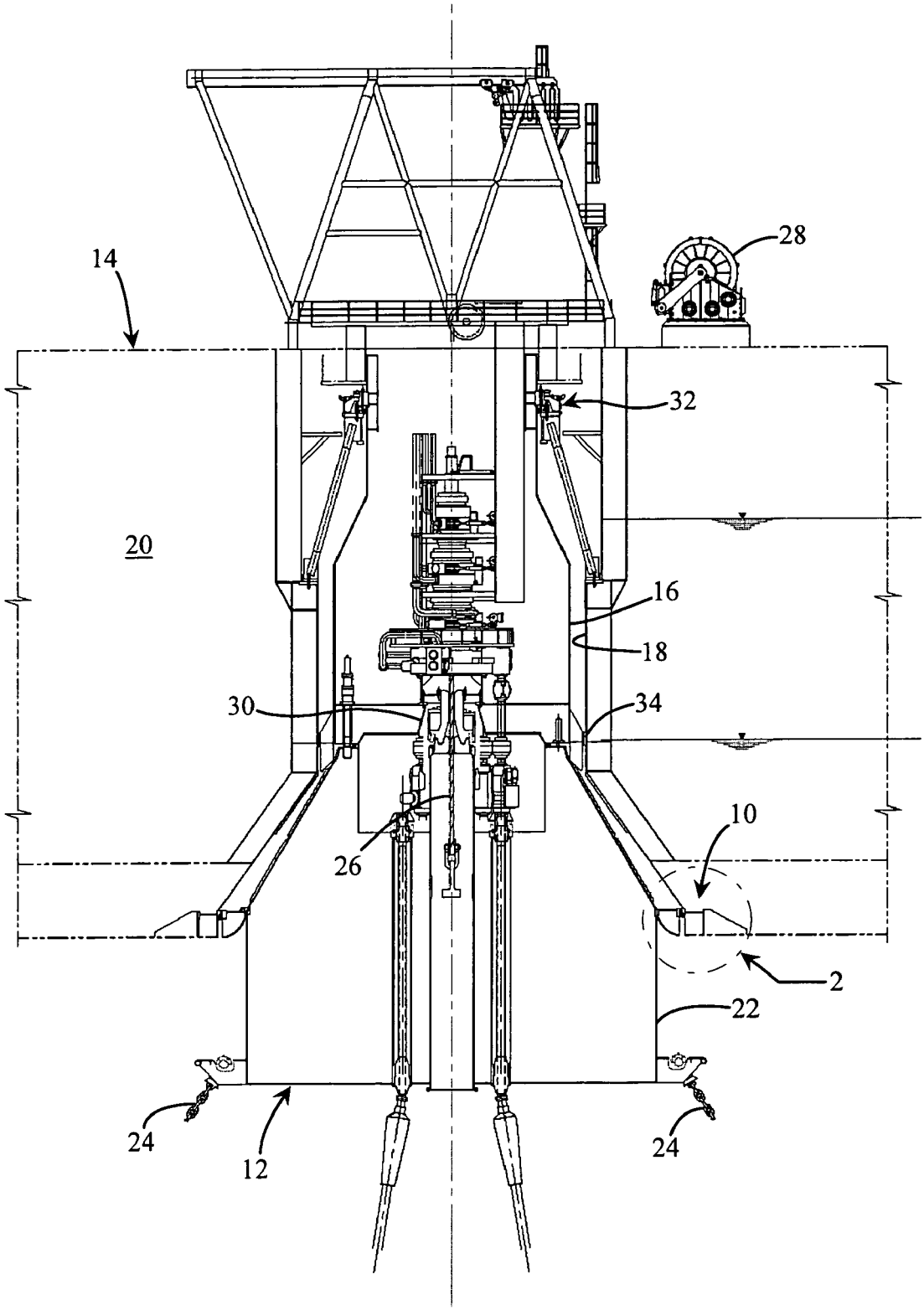
FIG. 1 is a cross sectional view of a turret mooring system which comprises the lower bearing assembly of the present invention.

Referring to FIG. 1, the lower bearing assembly of the present invention, which is indicated generally by reference number 10, is shown installed in an exemplary turret mooring system 12 for a vessel 14. The turret mooring system 12 comprises a turret 16 which is mounted in a moon pool 18 that is formed in the hull 20 of the vessel 14. The turret 16 is secured to a disconnectable buoy 22 which in turn is anchored to the sea floor using a number of mooring chains 24. In use, the buoy 22 is hoisted from a submerged position to the turret 16 using a pull-in rope 26 that is attached to a hoist 28, and the buoy is connected to the turret with a conventional structural collet connector 30.

The turret 16 is rotatably supported in the moon pool 18 with an upper bearing assembly 32 and, when the buoy 22 is attached to the turret, the lower bearing assembly 10. In this manner, the vessel 14 is allowed to weathervane around the turret 16 while still being firmly anchored to the sea floor. The upper bearing assembly 32 ideally comprises a combination thrust and radial bearing, such as a conventional three-row roller bearing, which supports the weight of the turret 16 and the mooring chains 24 and accommodates the horizontal and vertical mooring loads acting between the turret and the hull 20. The lower bearing assembly 10, in contrast, preferably comprises only a radial bearing, which accommodates the horizontal loads acting between the buoy 22 and the hull 20. If desired, the turret mooring system 12 may also include a number of bumper pads 34, which may be comprised of, for example, rubber or polyethylene, to cushion the lower portion of the turret 16 from the hull 20 prior to connecting the buoy 22 to the turret.

In accordance with the present invention, the lower bearing assembly 10 is installed in or adjacent the bottom of the moon pool 18 between the buoy 22 and the hull 20. In this position, the lower bearing assembly 10 operates to transmit the horizontal mooring loads from the buoy 22 directly to the vessel 14, instead of through the turret 16. As a result, the turret 16 may be both shorter and lighter than those previously required for similar anticipated mooring loads.

Figure 2:
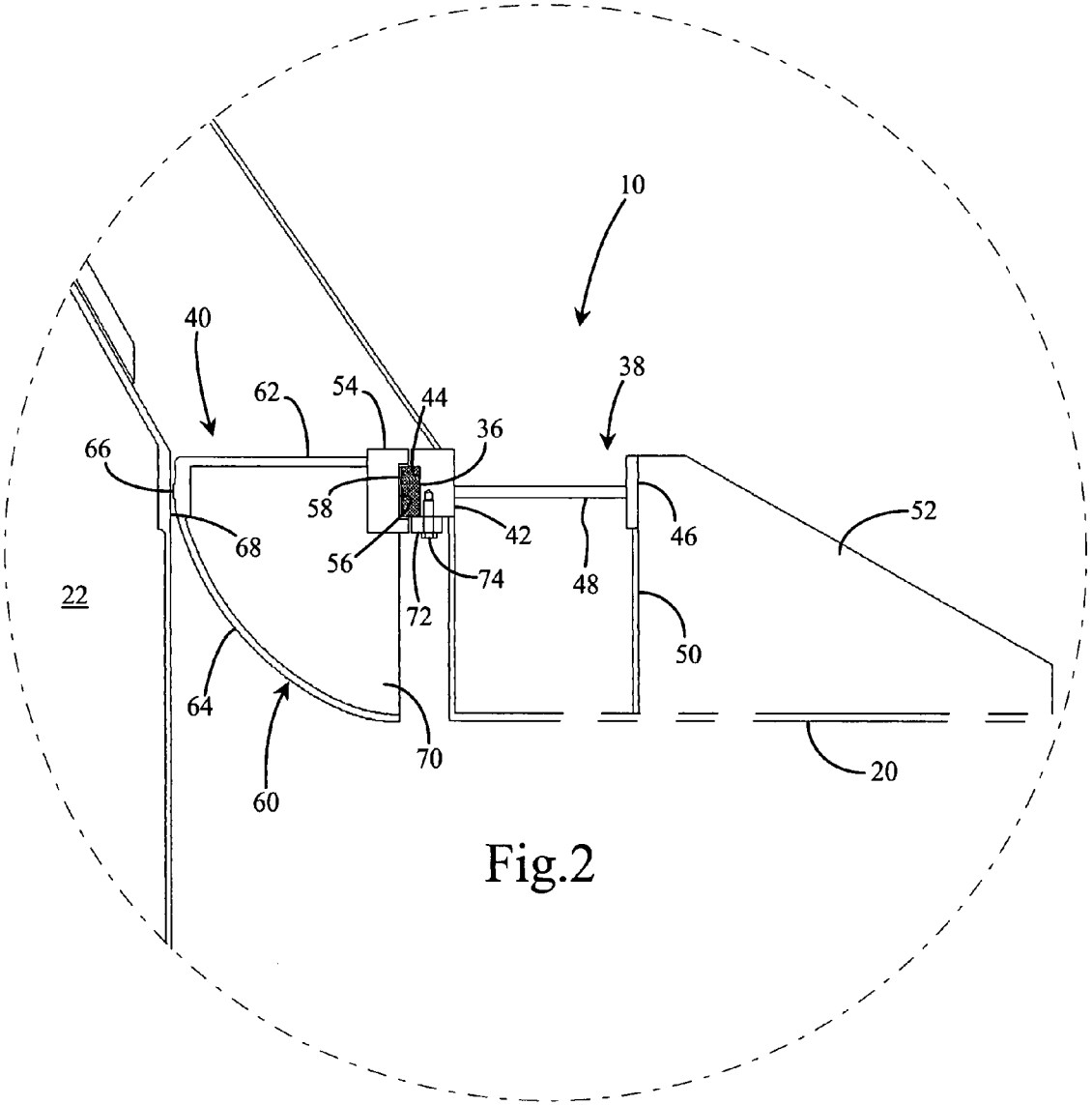
FIG. 2 is an enlarged cross sectional view of a portion of the lower bearing assembly shown in FIG. 1.

Referring to FIG. 2, the lower bearing assembly is shown to comprise a bearing ring 36 which is disposed between a bearing support ring 38 that is attached to the hull 20 and a reaction ring 40 that is positioned adjacent the buoy 22. The bearing ring 36 is ideally constructed of a compliant material, such as a self-lubricating fiber reinforced polymer, an example of which is Orkote. In addition, the bearing ring 36 is optimally comprised of a number of segments to facilitate the assembly of the lower bearing assembly 10. Each segment of the bearing ring 36 ideally has a generally rectangular cross section and a length of between two and three feet.

The bearing support ring 38 includes a circular inner ring 42 which in cross section comprises a generally rectangular groove 44 that is adapted to receive at least a portion of the bearing ring 36. The inner ring 42 is constructed of a suitable, preferably metallic material, such as carbon steel, and is attached to the hull 20 such as by welding. In an illustrative embodiment of the invention, the bearing support ring 38 also includes a circular outer ring 46 which is connected to the inner ring 42 with a number of struts 48. The outer ring 46 is ideally secured to a cylindrical hoop 50 which is attached to the hull 20 with a number of ribs 52. In this manner, lateral forces acting on the inner ring 42 will be transmitted through the struts 48 and the outer ring 46 to the hoop 50 and the ribs 52.

Referring still to FIG. 2, the reaction ring 40 includes a circular retainer ring 54 which in cross section is shown to comprise a generally rectangular pocket 56 that is adapted to receive at least a portion of the bearing ring 36. The retainer ring 54 is constructed of a suitable, preferably metallic material, such as carbon steel. However, the pocket 56 ideally comprises an overlay 58 of, for example, stainless steel, to provide superior corrosion resistance and a lower coefficient of friction.

The reaction ring 40 also includes an annular bumper 60 which is attached to the retainer ring 54 such as by welding. The bumper 60 comprises a generally flat upper surface 62, an outer surface 64, and a radial reaction surface 66 which is formed on an upper portion of the outer surface and which is adapted to engage a corresponding cylindrical bearing surface 68 on the buoy 22. In addition, the bumper 60 may include a number of spars 70 which each extend between the outer surface 64 and the retainer ring 54 to provide lateral support for the bumper 60. Also, the outer surface 64 is preferably curved as shown in FIG. 2 to provide a bending radius for the pull-in rope 26 during retrieval of the submerged buoy 22.

During assembly of the lower bearing assembly 10, the bearing ring 36 is positioned in the pocket 56 of the retainer ring 54, and then the reaction ring 40 is raised into the support ring 38 until the top of the bearing ring engages the top of the groove 44. The bearing ring 36 is then secured in position with an annular retaining plate 72, which is ideally secured to the inner ring 42 with a number of bolts 74. In this regard, the retaining plate 72 may comprise a plurality of individual segments to facilitate the assembly of the bearing assembly 10.

In operation of the lower bearing assembly 10, the horizontal mooring loads from the buoy 22 are transmitted through the reaction ring 40 to the bearing ring 36, from the bearing ring to the support ring 38, and from the support ring to the hull 20. Due to the relatively high frictional force between the buoy 22 and the reaction ring 40 and the relatively low frictional force between the retainer ring 54 and the bearing ring 36, any rotation of the buoy relative to the hull 20 will tend to rotate the reaction ring relative to the bearing ring. Therefore, neither the buoy 22 nor the reaction ring 40 will be subject to undue wear. Rather, the majority of the wear in the lower bearing assembly 10 will be borne by the bearing ring 36, which may be replaced if need be.

Figure 3:
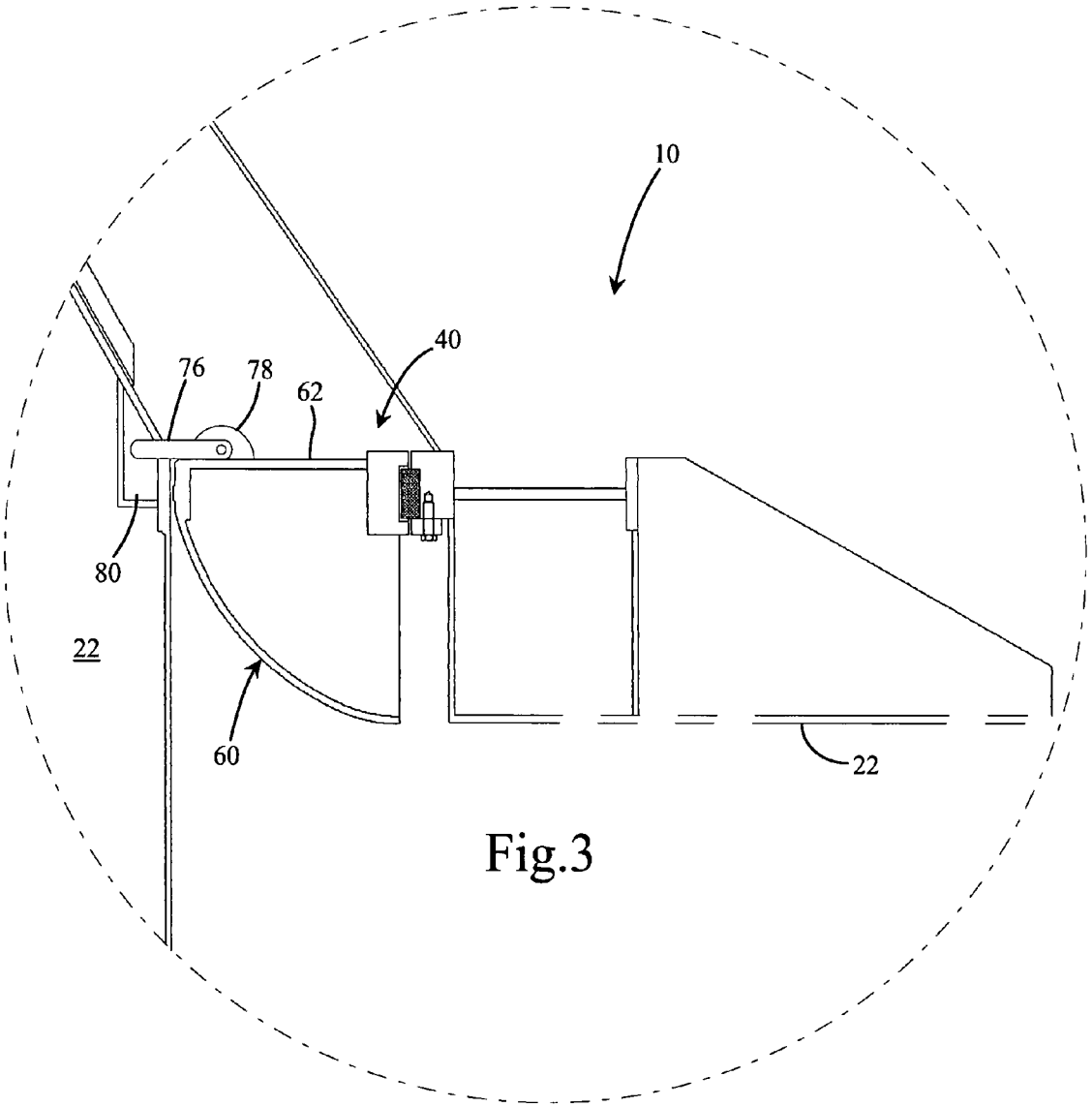
FIG. 3 is an enlarged cross sectional view of the lower bearing assembly in accordance with another embodiment of the invention.

In accordance with a preferred embodiment of the present invention, the lower bearing assembly also comprises means to prevent the reaction ring 40 from rotating relative to the buoy 22. Referring to FIG. 3, such rotation prevention means may include a number of pins 76, each of which is pivotally connected to the reaction ring 40 through, for example, a corresponding pad eye 78 that is welded to the upper surface 62 of the bumper 60. Each pin 76 is pivotable in a vertical plane and is adapted to fall into a corresponding slot 80 in the buoy 22 as the buoy is hoisted to the turret 16. Thus, as the buoy 22 rotates, the slots 80 will engage the pins 76 and force the reaction ring 40 to rotate. The rotation prevention means will therefore ensure that any relative rotation between the buoy 22 and the hull 20 will occur between the reaction ring 40 and the bearing ring 36. Consequently, the rotation prevention means will prevent the buoy 22 and the reaction ring 40 from experiencing undue wear.

It should be recognized that, while the present invention has been described in relation to the preferred embodiments thereof, those skilled in the art may develop a wide variation of structural and operational details without departing from the principles of the invention. Therefore, the present application should be construed to cover all equivalents falling within the true scope and spirit of the invention.

What is claimed is:

1. A turret mooring system for a vessel which comprises:

a turret which is rotatably connected to the vessel and comprises a lower end;

a buoy which is anchored to the sea floor and is releasably connectable to the lower end; and a bearing assembly which is positioned between the buoy and the vessel and is capable of directly contacting the surfaces thereof when the buoy is connected to the turret;

wherein horizontal mooring loads acting on the buoy are transmitted through the bearing assembly to the vessel.

2. The turret mooring system of claim 1, wherein the bearing assembly comprises a bearing ring which is supported on one of the vessel and the buoy.

3. The turret mooring system of claim 2, wherein the bearing ring is comprised of a self-lubricating material.

4. The turret mooring system of claim 2, wherein the bearing ring is comprised of a polymer material.

5. The turret mooring system of claim 2, wherein the bearing ring is comprised of a fiber reinforced polymer material.

6. The turret mooring system of claim 2, wherein the bearing ring comprises a plurality of bearing segments.

7. The turret mooring system of claim 2, wherein the bearing assembly further comprises:

a bearing support ring which is connected to one of the vessel and the buoy; and a reaction ring which is positioned concentrically relative to the bearing support ring and is adapted to engage the other of the vessel and the buoy;

wherein the bearing ring is disposed between the bearing support ring and the reaction ring.

8. The turret mooring system of claim 7, wherein the bearing support ring includes a circular first ring which in cross section comprises a groove that is adapted to receive at least a portion of the bearing ring.

9. The turret mooring system of claim 8, wherein the bearing support ring further comprises a circular second ring which is positioned concentrically relative to the first ring and is connected to both the first ring and one of the vessel and the buoy.

10. The turret mooring system of claim 9, wherein the second ring is positioned concentrically around the first ring and is connected to the vessel.

11. The turret mooring system of claim 7, wherein the reaction ring includes a circular retainer ring which in cross section comprises a pocket that is adapted to receive at least a portion of the bearing ring.

12. The turret mooring system of claim 11, wherein the pocket comprises an overlay which is comprised of a corrosion-resistant material.

13. The turret mooring system of claim 11, wherein the reaction ring further comprises an annular bumper which is connected to the retainer ring and is adapted to engage the other of the vessel and the buoy.

14. The turret mooring system of claim 13, wherein the bumper comprises a curved outer surface.

15. The turret mooring system of claim 7, further comprising means for preventing the reaction ring from rotating relative to the other of the vessel and the buoy.

16. The turret mooring system of claim 15, wherein the preventing means comprises:

a number of pins which are pivotably connected to the reaction ring; and a number of corresponding slots which are formed in the other of the vessel and the buoy;

wherein the pins are pivotable from a first position in which they are clear of the slots to a second position in which they are engaged by the slots.

* * * * *